US007234998B2

(12) United States Patent
Aoyagi et al.

(10) Patent No.: US 7,234,998 B2
(45) Date of Patent: Jun. 26, 2007

(54) CHEMICAL MECHANICAL POLISHING METHOD, CHEMICAL MECHANICAL POLISHING SYSTEM, AND MANUFACTURING METHOD OF SEMICONDUCTOR DEVICE

(75) Inventors: Masahiro Aoyagi, Hitachinaka (JP); Aki Nakajo, Yokohama (JP); Hirofumi Tsuchiyama, Hitachinaka (JP); Shinobu Nakamura, Abiko (JP)

(73) Assignee: Trecenti Technologies, Inc., Ibaraki (JP)

( * ) Notice: Subject to any disclaimer, the term of this patent is extended or adjusted under 35 U.S.C. 154(b) by 161 days.

(21) Appl. No.: 11/063,997

(22) Filed: Feb. 24, 2005

(65) Prior Publication Data

US 2005/0197046 A1 Sep. 8, 2005

(30) Foreign Application Priority Data

Mar. 4, 2004 (JP) ..... 2004-061284
Dec. 28, 2004 (JP) ..... 2004-378751

(51) Int. Cl.
*B24B 49/00* (2006.01)

(52) U.S. Cl. ..... 451/5; 451/41

(58) Field of Classification Search ..... 451/5, 451/8, 10, 11, 41; 438/691; 700/117, 121, 700/182

See application file for complete search history.

(56) References Cited

U.S. PATENT DOCUMENTS 6,231,425 B1 * 5/2001 Inaba et al. ..... 451/5
6,884,147 B2 * 4/2005 Toprac ..... 451/5
6,965,809 B2 * 11/2005 Dickenscheid et al. ..... 700/117
2004/0023490 A1 2/2004 Wollstein et al.
2004/0166685 A1 * 8/2004 Birang et al. ..... 438/691

FOREIGN PATENT DOCUMENTS

JP 11-186204 12/1997
JP 2002-154053 11/2000
JP 2002-334135 5/2001

* cited by examiner

*Primary Examiner*—Jacob K. Ackun, Jr.
(74) *Attorney, Agent, or Firm*—Reed Smith LLP; Stanley P. Fisher, Esq.; Juan Carlos A. Marquez, Esq.

(57) ABSTRACT

Setting a polishing rate and a polishing time in chemical mechanical polishing can be performed with high accuracy by considering a product wafer of an object to be polished, and an instrumental error between apparatuses to be used, etc. By using, as a calculating formula, a formula well approximating a portion of a curve representing a state of chemical mechanical polishing on a side showing a target polishing amount, the polishing rate and the polishing time can be set with high accuracy according to a state of chemical mechanical polishing for actually polishing a product wafer. In the calculating formula, a parameter "A" relating to a film property of a film of an object to be polished, a parameter "B" relating to a roughness state of a film surface, and a parameter "C" relating to an instrumental error differential between apparatuses of a chemical mechanical polishing apparatus are joined by operators.

5 Claims, 6 Drawing Sheets

*FIG. 6*

| | POLISHING CONDITION $\alpha$ | POLISHING CONDITION $\beta$ | POLISHING CONDITION $\gamma$ | |
|---|---|---|---|---|
| FILM TYPE A | 1.0 | 0.5 | 2.0 | |
| FILM TYPE B | 0.5 | 0.25 | 1.0 | |
| FILM TYPE C | 1.5 | 0.75 | 3.0 | |
| ⋮ | | | | |

TABLE SHOWING POLISHING RATES UNDER RESPECTIVE CONDITIONS IF IT IS ASSUMED THAT POLISHING RATE OF REFERENCE CONDITION (FILM TYPE "A", POLISHING CONDITION $\alpha$) IS 1.0.

CHEMICAL MECHANICAL POLISHING METHOD, CHEMICAL MECHANICAL POLISHING SYSTEM, AND MANUFACTURING METHOD OF SEMICONDUCTOR DEVICE

CROSS-REFERENCE TO RELATED APPLICATION

The present application claims priority from Japanese patent application No. JP 2004-061284 filed on Mar. 4, 2004 and No. 2004-378751 filed on Dec. 28, 2004, the contents of which are hereby incorporated by reference into this application.

BACKGROUND OF THE INVENTION

The present invention relates to manufacturing techniques of semiconductor devices, and particularly relates to techniques effectively applied to calculating, with high accuracy, a polishing condition such as a polishing rate in chemical mechanical polishing (CMP) based on past polishing records. Also, the polishing condition such as a polishing rate can be utilized for making the calculation easy and high accuracy in performing the chemical mechanical polishing to stacked films.

The below described techniques have been studied by the present inventors for accomplishing the present invention, and the outline thereof is as follows.

Recently, as demands for higher integration of semiconductor devices are increased, chemical mechanical polishing techniques are recognized as highly important techniques in a field of high-accuracy planarization of semiconductor wafers. Chemical mechanical polishing is carried out while slurry composed of abrasive grains and chemical solution is supplied between a rotating polishing pad and a surface of a semiconductor wafer to be polished.

In such chemical mechanical polishing, prior to actual polishing of a product wafer, a reference polishing rate for a chemical mechanical polishing apparatus to be used is set by use of a dummy wafer. Several actual wafers are subjected to the preceding polishing at the set reference polishing rate, excess or deficiency of the polishing time is checked from the result of the preceding polishing, and the optimum polishing time suitable for the already set reference polishing rate is set to carry out the polishing of subsequent products. The reference polishing rate is a very important factor for determining the quality of polishing, including setting accuracy of the polishing time. Therefore, the reference polishing rate is periodically revised in the subsequent product polishing, so that a value as accurate as possible is used.

As described above, in the chemical mechanical polishing, before polishing of a product wafer is started, a considerable number of preceding operations are required for setting various polishing conditions including setting of the reference polishing rate of the product wafer, for example, by using a dummy wafer, performing the preceding polishing, and the like.

Also, when the appropriate reference polishing rate cannot be set, the chemical mechanical polishing carried out for a predetermined time based on the above-mentioned polishing rate results in deficiency of polishing or excessive polishing, whereby additional polishing or disposal of the polished wafer is caused. As a result, a throughput in a chemical mechanical polishing process significantly deteriorates.

Thereat, techniques for efficiently calculating the polishing rate with high accuracy are demanded. As one of such techniques, there is proposed a technique in which: a latest polishing rate is calculated from an actual polishing time and a differential between film thickness data before the polishing and film thickness data after the polishing; and process recipe information from a plant host computer is set as an optimum recipe in a chemical mechanical polishing apparatus (See Patent Document 1: Japanese Patent Laid-open No. 11-186204).

There is also proposed a technique in which an optimum polishing time of an object to be polished is calculated based on a calculating formula arbitrarily set by using operators and parameters including pre-polishing thickness of the object to be polished, a polishing time, post-polishing thickness, and a target value of the thickness of the object to be polished (See Patent Document 2: Japanese Patent Laid-open No. 2002-154053).

Furthermore, there is also proposed a technique in which estimation polishing rates are calculated and an estimation polishing time is determined for each type, process, and manufacturing equipment (See Patent Document 3: Japanese Patent Laid-open No. 2002-334135).

Also, there is proposed a technique in which, in view of a topological state relating to irregular (concave/convex) patterns of the stacked films, chemical mechanical polishing of stacked films in an STI (Shallow Trench Isolation) structure is carried out by, for example, converting, to a silicon nitride film, silicon oxide and silicon nitride films to be subjected to the chemical mechanical polishing and uniformly calculating the polishing rate (see Patent Document 4: U.S. Patent Laid-open No. US 2004-0023490).

SUMMARY OF THE INVENTION

However, the present inventors have found out that the above-described technique for setting the polishing rate has the following problems.

That is, since the polishing rate is different depending on the pattern shape of the object to be polished, or the quality of the film to be polished, the technique disclosed in Patent Document 1 is a technique for setting the polishing pattern unsuitable for producing various types of products.

In the method described in Patent Document 2, change in the polishing rates changed along with time course in accordance with states of consumable materials of the apparatus is not taken into consideration, so that improving computational precision of the polishing rate cannot be expected. Also, in the technique, any method of determining the calculating formula for calculating the optimum polishing time is not described, so that the way how the polishing rate should be calculated is unclear.

Meanwhile, in the technique described in Patent Document 3, consideration is made so that estimation polishing rates can be calculated by means of weighting. However, definition of such weighting is unclear. Therefore, definition of the estimation polishing rates per se is ambiguous and accuracy of the estimation polishing rates to be calculated cannot be assured. Furthermore, if the model calculating formula is deviated from the actual one, there is the drawback of being unable to control the polishing amount or polishing time since a function of correcting the deviation is not provided.

Also, in the actual chemical mechanical polishing, the polishing state is greatly changed depending on the concave/convex pattern of the film that is the object to be polished.

However, techniques in which the polishing rates are considered on this point have not been provided.

Furthermore, in the chemical mechanical polishing, there is the case where a plurality of chemical mechanical polishing apparatuses are employed even in polishing product wafers in the same lot or where a plurality of polishing heads are used even in one chemical mechanical polishing apparatus. However, there have not been provided techniques in which influences of so-called instrumental errors as differentials between the apparatuses or heads on the polishing rates are considered. The present inventors have conceived that taking those points into consideration is important for calculating the polishing rate with high accuracy.

Furthermore, when the object to be subjected to chemical mechanical polishing has a multi-layer structure in which a plurality of layers are stacked, different polishing conditions have generally been employed for carrying out the chemical mechanical polishing. If the chemical mechanical polishing is performed by one chemical mechanical polishing apparatus to the multi-layer structure in which a plurality of layers are stacked, naturally, change of the polishing condition including an operation such as cleaning is required in course of polishing. Thus, the efficient chemical mechanical polishing cannot be expected.

Therefore, in some measures, a plurality of chemical mechanical polishing apparatuses are disposed so that the chemical mechanical polishing apparatuses are changed for each film type. Furthermore, there is also a measure in which a polishing head has a multi-configuration. However, costs of such configurations become considerably high in terms of equipment.

In addition, recently, a small-quantity production of various types of products is needed and therefore small-lot products are rapidly changed in some cases, so that taking a measure for each of the above cases is almost impossible for any of the above-described configurations.

Accordingly, the present inventors have conceived that, in performing the chemical mechanical polishing to the multi-layer structure in which a plurality of layers are stacked, if the polishing rates and the polishing times of other layers can be set in terms of those of one layer, the chemical mechanical polishing can be carried out to the other layers under the polishing condition of a layer serving as a reference, that is, simply by converting the polishing rates of the remaining layers to that of the reference layer.

Although the above-described points are disclosed also in Patent Document 4, the calculating formula depending on various factors has to be used for calculating the polishing time through conversion, and it is necessary to perform some required inputs to carry out computer calculation. Therefore, a quick response thereto is difficult to make. From the viewpoint of having a well knowledge of the actual chemical mechanical polishing, the present inventors have conceived that it is necessary to make the quick responses by making the conversion simpler.

Further, selecting the layer serving as a reference has to be appropriately changed based on the multi-layer structures. It is desirable that such responses can be made according to circumstances. Also, for engineers on job sites, if possible, it is desirable that how the responses should be made is visually shown as an image. In a method of substituting various parameters for the calculating formula and calculating the formula, the image thereof is not easily grasped and this causes determination to be delayed.

An object of the present invention is to set a polishing rate and a polishing time in the chemical mechanical polishing with high accuracy.

Another object of the present invention is to easily set a polishing rate and a polishing time in the chemical mechanical polishing, which is performed to an object with a multi-layer structure.

Still another object of the present invention is that instrumental errors generated between apparatuses are taken into consideration in setting the polishing rate and/or polishing time in the chemical mechanical polishing.

The above and other objects and novel features of the present invention will be apparent from the description of the present specification and the accompanying drawings.

Outlines of the representative ones of the inventions disclosed in the present application will be described as follows.

A calculating formula representing a polishing rate or polishing time is provided as a formula in which a parameter relating to a film quality, a parameter relating to a concave/convex pattern of a film that is an object to be polished, and a parameter representing an instrumental error between apparatuses are included, thereby calculating the polishing rate or polishing time in which any influences based on the film quality, the concave/convex pattern, and the instrumental error between apparatuses are considered.

Also, by use of a conversion table from which a polishing rate set from a layer-forming material and a polishing condition can be easily read, setting of the polishing time of one layer of a multi-layer structure can be easily carried out by converting the polishing time of one layer to that of a particular layer thereof.

Effects obtained by representative ones of inventions disclosed in the present application will be briefly described as follows.

The chemical mechanical polishing can be carried out with high accuracy by including, in the calculating formulas of the polishing rate or polishing time, the parameter relating to the film quality, the parameter relating to the convex/concave pattern, and the parameter relating to the instrumental error between apparatuses of the chemical mechanical polishing apparatus.

By correcting the polishing rate on the basis of the past polishing records of actual product wafers, calculation accuracy of the polishing rate can be further enhanced. Therefore, a polishing process can be made more efficient.

If the present invention is applied to a multi-layer structure, the conversion table is used to easily make conversion at a time when the chemical mechanical polishing of a plurality of stacked films is performed by converting it to the chemical mechanical polishing of one stacked film. In addition, the chemical mechanical polishing of the multi-layer structure can be carried out with high accuracy.

BRIEF DESCRIPTION OF THE DRAWINGS

FIG. 6 is an explanatory view for showing one example of a conversion table used in the chemical mechanical polishing method according to the present invention.

DESCRIPTION OF THE PREFERRED EMBODIMENTS

Figure 1A:
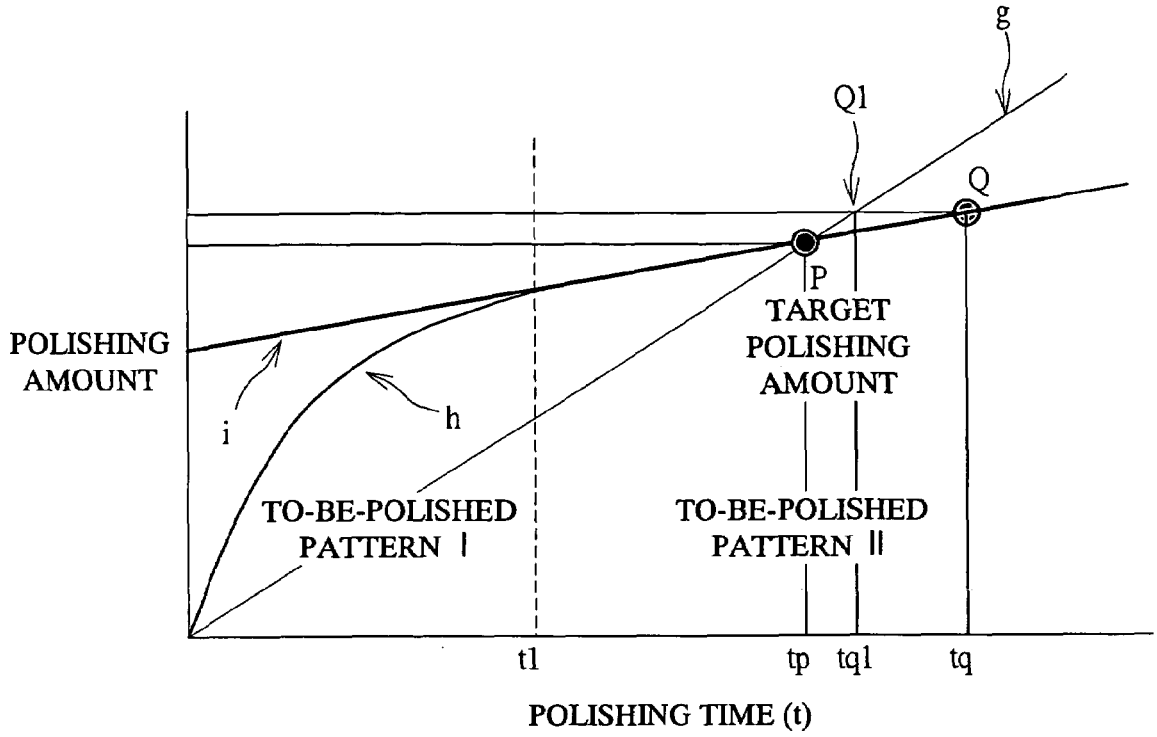
FIG. 1A is an explanatory view for illustrating an idea of a calculating formula used in the present invention.

Hereinafter, embodiments of the present invention will be detailed based on the accompanying drawings. Note that, throughout all the drawings for describing the embodiments, the same members or the like are basically denoted by the same reference numerals, and the repetition thereof will be omitted in some cases.

Figure 1B:
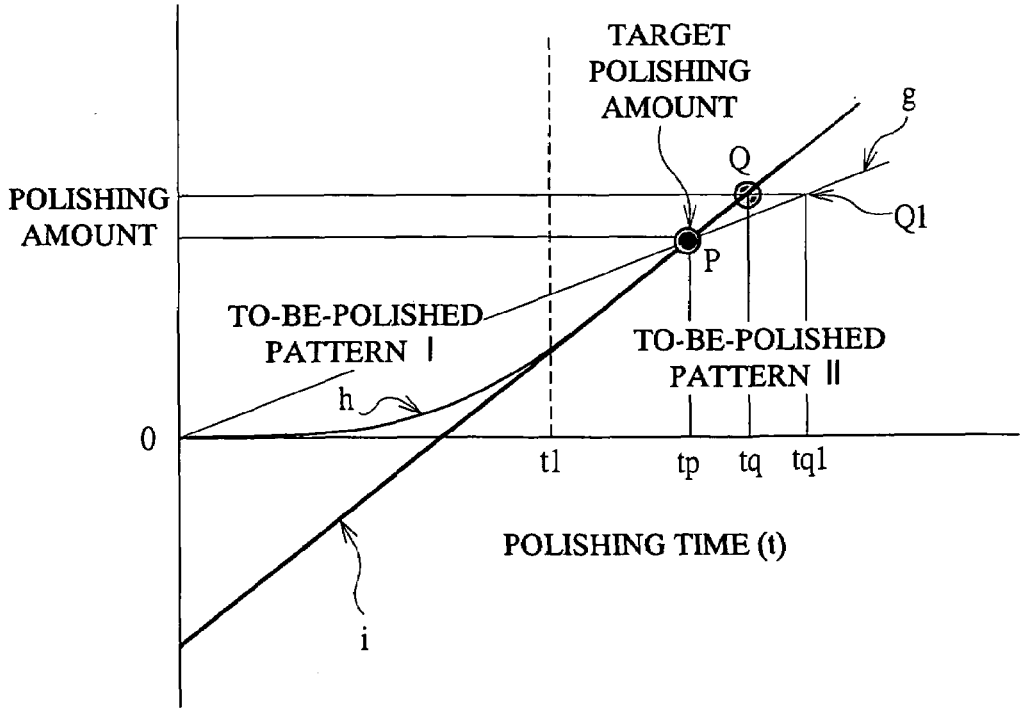
FIG. 1B is an explanatory view for illustrating an idea of a calculating formula used in the present invention.
Figure 2:
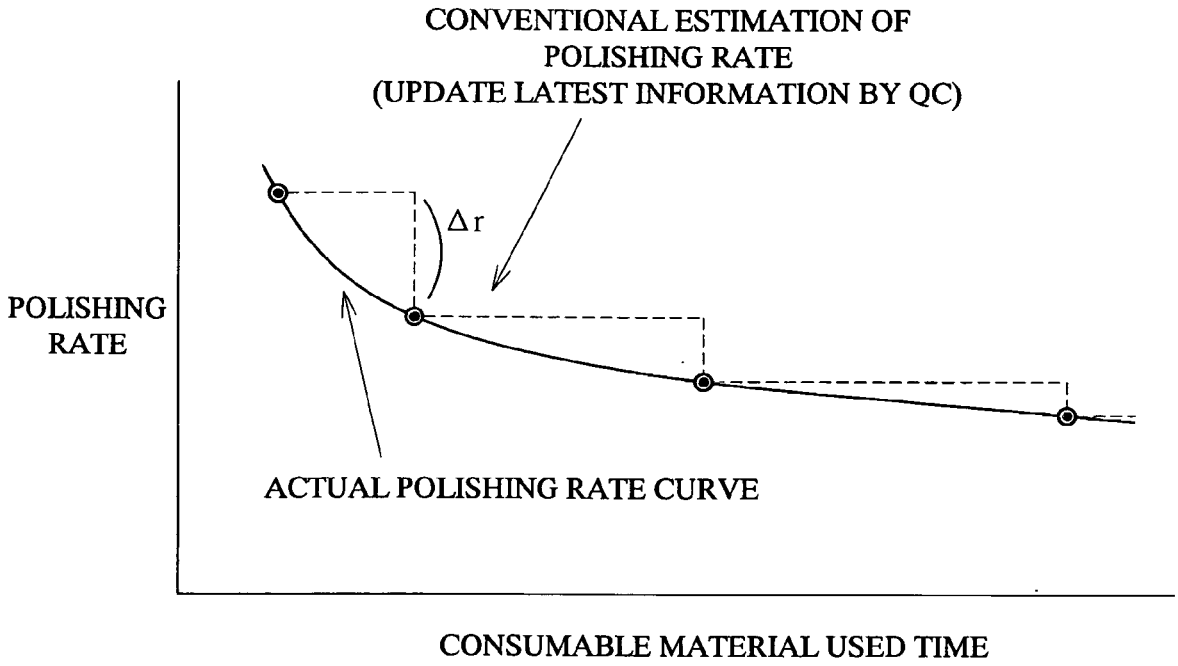
FIG. 2 is a view showing a transition state of a polishing rate in chemical mechanical polishing.
Figure 3:
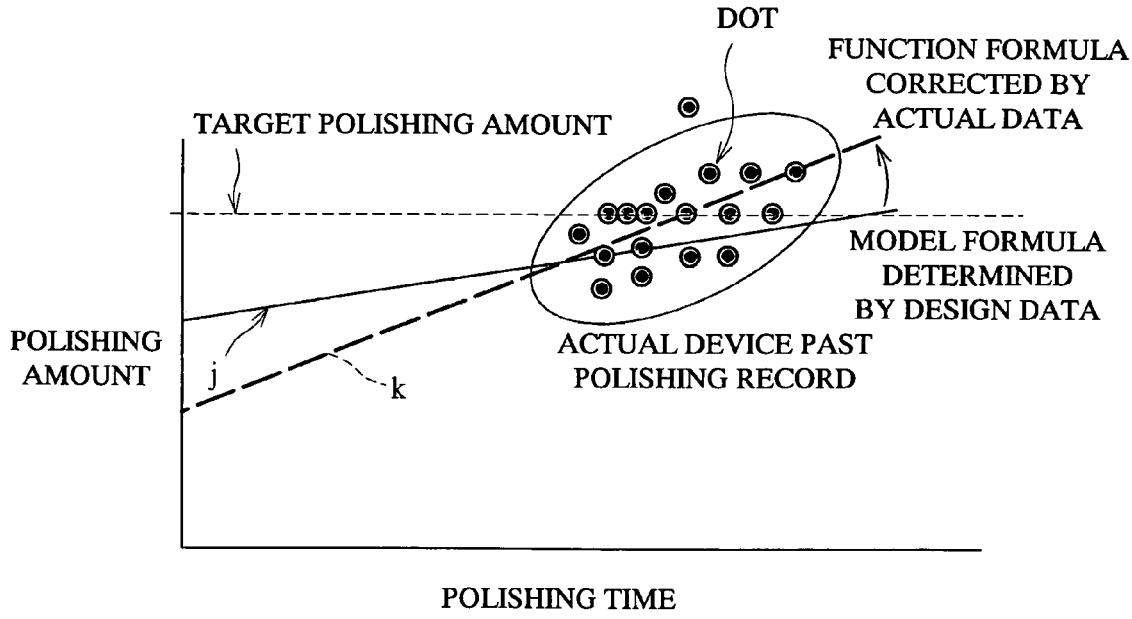
FIG. 3 is an explanatory view for illustrating a correcting idea of parameters constituting the calculating formula.
Figure 4:
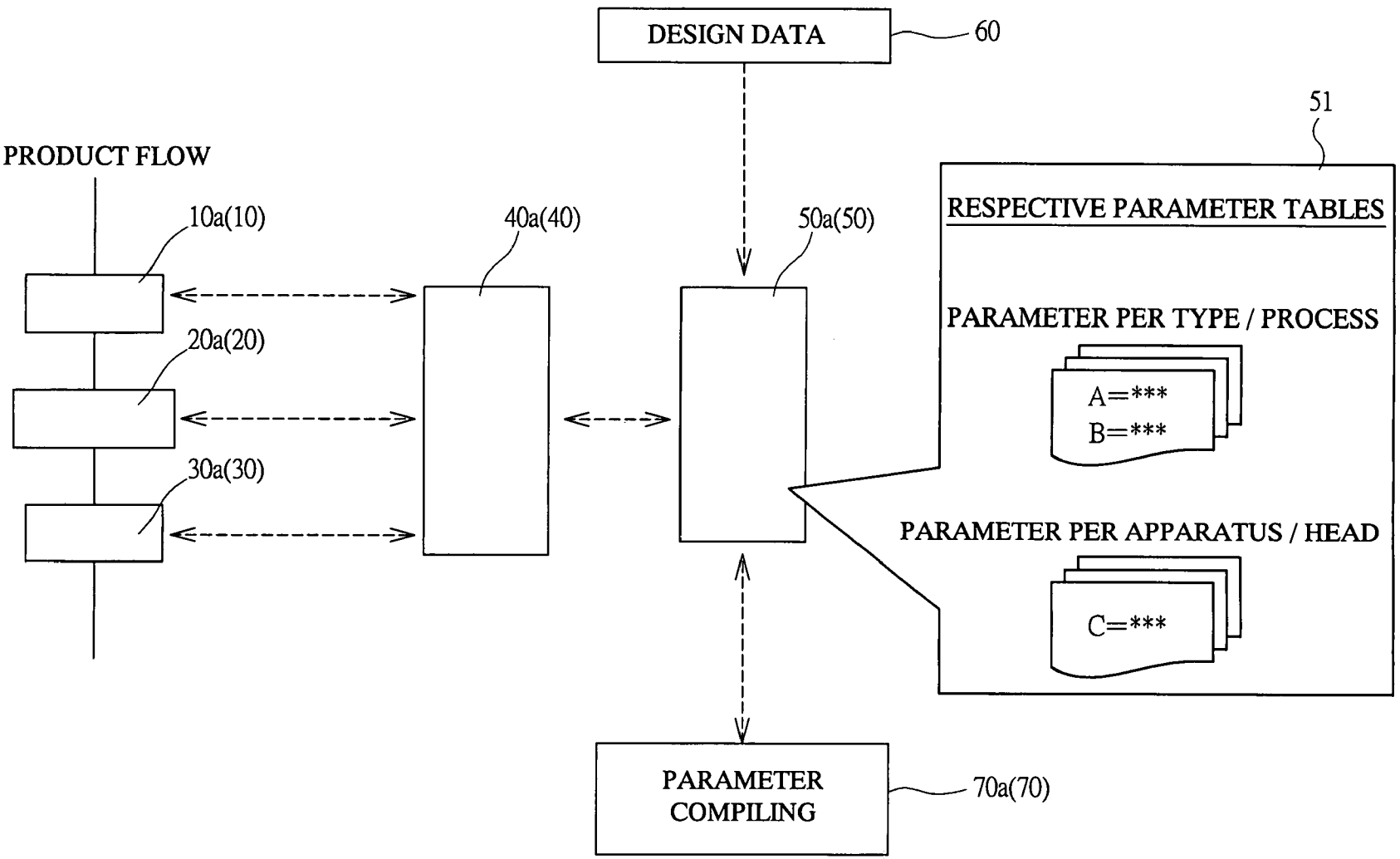
FIG. 4 is an explanatory view for showing one example of a chemical mechanical polishing system according to an embodiment of the present invention.
Figure 5A:
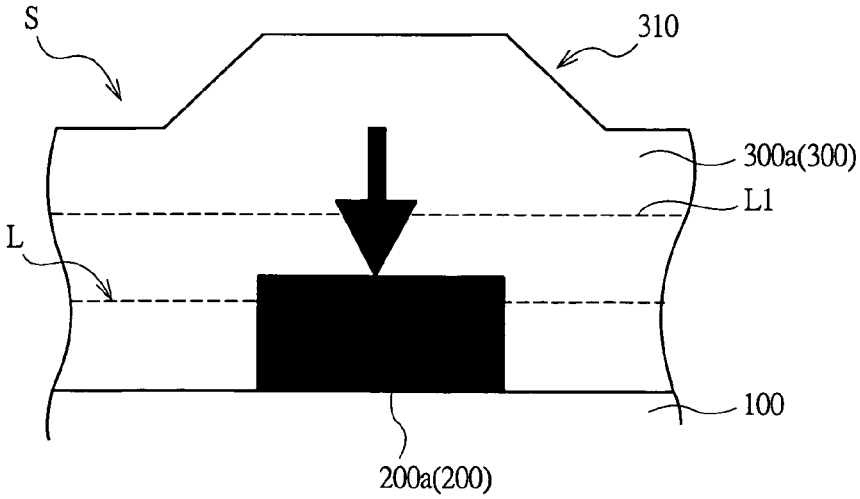
FIG. 5A is an explanatory view for showing a multi-layer structure as one example of an object to be polished in a chemical mechanical polishing method according to the present invention.
Figure 5B:
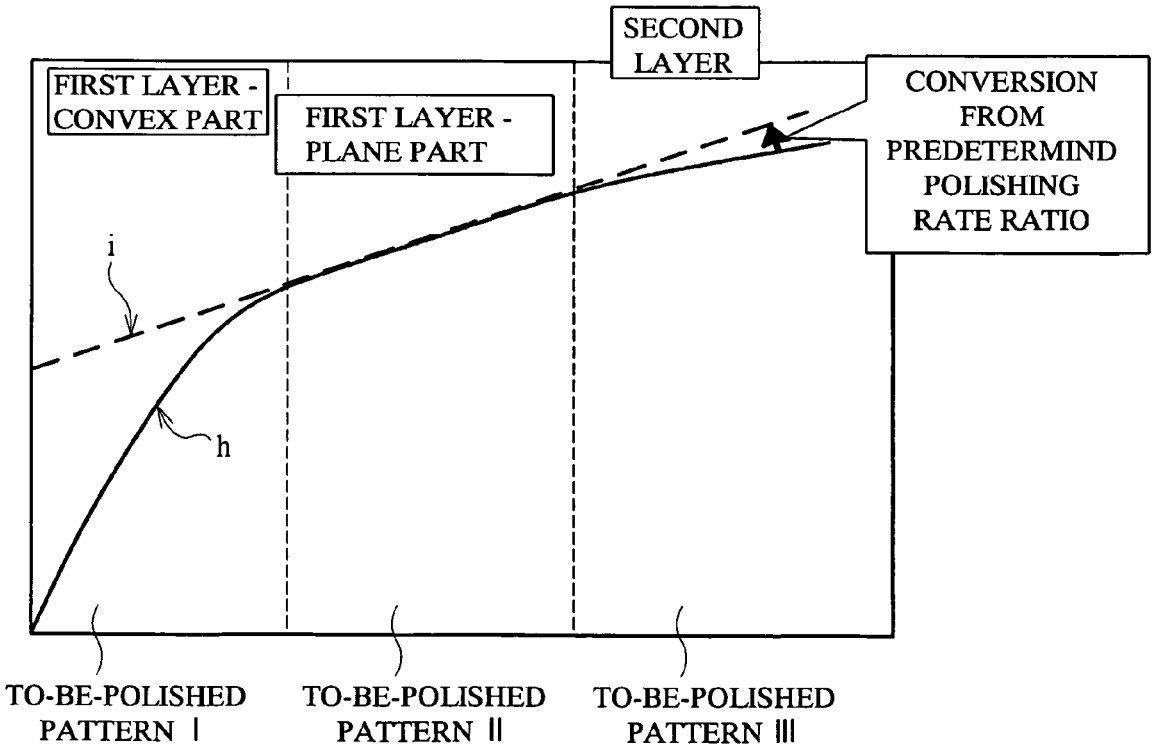
FIG. 5B is an explanatory view for showing an application state of the calculating formula in a chemical mechanical polishing method according to the present invention in which the object to be polished is a plurality of stacked films.

FIGS. 1A and 1B are explanatory views for illustrating ideas of calculating formulas used in the present invention, respectively. FIG. 2 is a view showing a transition state of a polishing rate in chemical mechanical polishing. FIG. 3 is an explanatory view for illustrating a correcting idea of parameters constituting the calculating formula. FIG. 4 is an explanatory view for showing one example of a chemical mechanical polishing system according to an embodiment of the present invention. FIG. 5A is an explanatory view for showing a multi-layer structure as one example of an object to be polished in a chemical mechanical polishing method according to the present invention, and FIG. 5B is an explanatory view for showing an application state of the calculating formula in a chemical mechanical polishing method according to the present invention in which the object to be polished is a plurality of stacked films. FIG. 6 is an explanatory view for showing one example of a conversion table used in the chemical mechanical polishing method according to the present invention.

First Embodiment

In a chemical mechanical polishing method of the present invention, a polishing condition such as a polishing rate or polishing time is calculated by use of a novel calculating formula, whereby chemical mechanical polishing is carried out. The novel calculating formula comprises a term dependent on a product wafer that is an object to be subjected to the chemical mechanical polishing and a term dependent on an apparatus for performing the chemical mechanical polishing to the product wafer, wherein the respective terms are combined by operators.

Under the condition that it is assumed that influences of the chemical mechanical polishing apparatus to be used on polishing conditions are the same, the term dependent on the product wafer has at least a parameter "A" exclusively representing influences of a film property such as film quality on the polishing condition, and a parameter "B" exclusively representing influences of a roughness state such as concave/convex patterns of the film, which is an object to be polished, on the polishing condition. Each of the numerical values of the parameters "A" and "B" can be independently set. The parameters "A" and "B" are combined respectively by operators, thereby constituting the terms dependent on the product wafer.

The numerical value data of the parameters "A" and "B" can be updated, as occasion demands, by changing, compiling, or the like based on design data, measurement results or the like of past polishing records of product wafers.

In the present specification, the word "product wafer" means a wafer that is a production object to be subjected to chemical mechanical polishing, and is used for distinguishing it from a dummy wafer used for obtaining conditions of the chemical mechanical polishing.

The film property relating to the parameter "A" means chemical property or physical property of a film that influences the polishing condition, and an example of the film property includes film quality representing the hardness or softness of a film.

The roughness state relating to the parameter "B" means an irregularity (concave/convex) state of a surface of a film that is an object to be subjected to the chemical mechanical polishing, and means a state of roughness generated due to, for example, non-uniformity in a pattern density of the lower layer covered by the film or in uniformity of film thickness at a time of film formation.

The past polishing record means such matter that a polishing state of performing actually the chemical mechanical polishing to a product wafer can be understood as numerical values, and, for example, film thickness, a polishing amount, or the like after the polishing is given as one example of the above matter.

The polishing condition means a condition to be considered when the chemical mechanical polishing is actually carried out by the chemical mechanical polishing apparatus, and one example thereof includes a polishing amount, a polishing speed, a polishing rate, polishing time, or the like.

Meanwhile, under the condition that it is assumed that influences of the product wafer, which is the object to be polished, on the polishing conditions are the same, the term dependent on the apparatus has a parameter "C" exclusively representing the influences of the chemical mechanical polishing apparatus on the polishing conditions. The parameter "C" can be set for each chemical mechanical polishing apparatus, and constitutes the term dependent on the apparatus.

When a plurality of chemical mechanical polishing apparatuses are used, as described above, the parameter "C" can be set individually for each of the chemical mechanical polishing apparatuses. For example, in the case of a multi-head configuration in which one chemical mechanical polishing apparatus has a plurality of polishing heads, the parameter "C" is set for each of the plurality of polishing heads. Therefore, the parameter "C" can be understood as a parameter representing the instrumental errors between the apparatuses.

If it is assumed that an operator representing any one of addition, subtraction, multiplication, and division (+, −, ×, and ÷) is represented by the symbol "*", the calculating formulas used for the present invention will be represented as follows. That is, "polishing condition" (polishing rate, polishing time, etc.)="product-wafer dependent term"*"apparatus dependent term" formula 1, and "product-wafer dependent term"=$f(A, B)$ and "apparatus dependent term"=$g(C)$, where "$f$" and "$g$" mean functions formula 2.

Examples more specifically representing the above-described calculating formulas include the following formulas. In the following calculating formulas, the parameter "A" dependent on the film property, the parameter "B" dependent on the roughness state of the film, and the parameter "C" dependent on the instrumental errors between the apparatuses are combined via the operators. That is, "polishing rate"={("pre-polishing film thickness"−"target film thickness")−(B+C)}/(A×"polishing time") formula 3; and "polishing time"={("pre-polishing film thickness"−"target film thickness")−(B+C)}/(A×"polishing rate") formula 4.

The formula 4 is a modification of formula 3, and both formulas are the same.

The above-described term ("pre-polishing film thickness"−"target film thickness") representing the polishing amount of formula 3 or 4 is a calculating formula obtained by combining the term 'A×("polishing rate"×"polishing time")+(B)' and the term comprising the parameter "C" through the operator. The term 'A×("polishing rate"×"polishing time")+(B)' can be assumed as a product-wafer dependent term in which the parameters "A" and "B" are combined through the operator. The term about the parameter "C" can be assumed as an apparatus-dependent term comprising the parameter "C" representing the instrumental errors between the apparatuses. Therefore, it can be assumed that the formula 3 or 4 indicates more specifically the formula 1 or 2.

In course of observing actually the chemical mechanical polishing of the product wafer, the present inventors have found out that the proposed calculating formulas well approximately express the state of the chemical mechanical polishing.

That is, in the actual chemical mechanical polishing of the product wafer, when the film thickness is monitored during the chemical mechanical polishing, the film thickness varies along with the polishing time in a logarithm-approximated manner. When the state is shown as a two-axis graph of the polishing amount and the polishing time, it will be shown by, for example, FIGS. 1A and 1B. That is, the state of the chemical mechanical polishing can be understood by a log approximation curve "h". A point "P" on the log approximation curve "h" is a point representing a target polishing amount.

Note that FIG. 1A shows the case where film-thickness monitoring is carried out at a convex part of a concave/convex pattern on the film surface of the product wafer that is an object to be polished and FIG. 1B shows the case where the film-thickness monitoring is carried out at a concave part thereof.

The present inventors have found that, as shown in FIGS. 1A and 1B, the transition of the log approximation curve "h" from start of the polishing to finish of the polishing by achieving the target polishing amount can be broadly divided into two patterns depending on the state of the product wafer to be polished. As shown in FIGS. 1A and 1B, such patterns are illustrated as patterns to be polished I and II.

They have found out that the above patterns can be divided into: a pattern ranging from a state, in which the concave/convex roughness is present on the film surface before the polishing, to the flat film surface achieved to some extent after start of the chemical mechanical polishing (as illustrated as a to-be-polished pattern I in the drawings); and a pattern ranging from after the film surface is flattened to some extent, to arrival of the entire film surface, which is subjected to the chemical mechanical polishing, at the target film thickness (as illustrated as a to-be-polished pattern II in the drawings). As shown in FIGS. 1A and 1B, it can be understood that the actual polishing state goes through the to-be-polished pattern I and then shifted to the to-be-polished pattern II.

The case of FIG. 1A will be described as an example. In the to-be-polished pattern I, when the chemical mechanical polishing is started, the convex part in the concave/convex pattern of the film surface that is an object to be polished is subjected to the polishing at first. Therefore, the polishing amount per unit time increases greatly and steeply. As the polishing progresses and the convex part is reduced, a gradient of the steep curve representing the polishing amount per unit time smoothes or becomes shelving.

As shown in FIG. 1A, after a time t1 has elapsed from the start of the polishing, the polishing amount per unit time can be approximated by a straight line which is inclined by an approximately constant angle. The time t1 is a transition time from the to-be-polished pattern I to the to-be-polished pattern II. It can be understood that the to-be-polished pattern I is a pattern in which the roughness state of the film influences exclusively the polishing conditions such as the polishing amount, the polishing speed, and the polishing time.

Meanwhile, it can be understood that, after the polishing time t1 has elapsed, the factors influencing the above-described polishing conditions of the chemical mechanical polishing are mainly influenced by not the roughness state such as the concave/convex pattern of the film surface but the film property such as the film quality. That is, the present inventors have understood that, the parameter "B" greatly influences an area of the to-be-polished pattern I and the parameter "A" greatly influences the area of the polish-subjected pattern II.

At a time of performing the chemical mechanical polishing, if the chemical mechanical polishing is ideally carried out by obtaining the formula of the log approximation curve "h" representing the actual state of the chemical mechanical polishing and calculating the required polishing condition such as a polishing rate or polishing time from the formula, it is preferable that the polishing rate or polishing time corresponding to the actual state of the chemical mechanical polishing can be estimated. However, in reality, it is expected that the log approximation curve "h" obtained by considering various factors is shown by a complicated formula, so indicating functionally the curve by using any formulas is difficult in reality.

Therefore, how to derive, as a calculating formula, an approximation formula corresponding to the actual state of the chemical mechanical polishing represented by such a log approximation curve "h" is required for obtaining a more accurate polishing rate or for calculating an estimation of the polishing time.

In view of the foregoing description, the present inventors have thought that it is unnecessary to approximate the entirety of the log approximation curve "h" at a time of approximating the log approximation curve "h". In the log approximation curve "h", as described above, portions belonging to the area of the to-be-polished pattern I are ones representing the state of the chemical mechanical polishing at the beginning, and a finish point of polishing representing the final polishing amount will be present in the area of the to-be-polished pattern II.

Accordingly, the present inventors have conceived that it is preferable that approximations of portions of the log approximation curve "h" in the area of the to-be-polished pattern II can be made.

As shown in FIG. 1A, in the area of the to-be-polished pattern II, the log approximation curve "h" extends along a straight line of which a gradient is constant. Therefore, the present inventors have thought that approximations of such portions can be sufficiently properly made by using the above-mentioned straight line as an asymptotic line of the log approximation curve "h". Conceivably, the assumption that the point representing a finish point of polishing, i.e., the point representing the final polishing amount is on the straight-line formula of the asymptotic line is sufficiently effective. The asymptotic line is represented as a straight line "i" (shown by a bold line in the drawing). The straight line "i" can be represented by a straight-line formula with some intercept.

As shown in FIG. 1A, the straight line "i" can be represented as a function, which depends on a film property such as film quality and is proportional to a polishing time and/or a polishing rate (polishing amount per unit time) in the area of the to-be-polished pattern II. The line "i" is a function depending on a parameter relating to the film property such as film quality and on the polishing time.

Meanwhile, the intercept can be assumed to be caused by the area of the to-be-polished pattern I showing influences of the roughness state such as a concave/convex pattern of the film surface of the object to be polished. Therefore, it is conceived that the intercept will have a function of a parameter relating to the concave/convex pattern.

Accordingly, in view of the foregoing description, the present inventors have conceived that if it is assumed that a parameter relating to a film property such as film quality is "A" and a parameter relating to a roughness state such as a concave/convex pattern of a film is "B" and a parameter relating to instrumental errors between apparatuses is "C", for example, the following approximation formula is established. That is, $$\text{"polishing amount"}=(A\times\text{"polishing rate"}\times\text{"polishing time"}+B)*C \qquad \text{formula 5.}$$

The above-described formula 5 shows that the parameter "C" relating to the instrumental errors between the apparatuses is associated with the polishing parameters "A" and "B" by use of the operator which is any one of the addition, subtraction, multiplication, and division.

As the case where the instrumental errors between the apparatuses actually influence the chemical mechanical polishing, the present inventors can refer to, for example, the case where a time lag is generated between a start of measurement of the polishing time and an actual start of the polishing. That is, there arises the case where the time lag, which should be originally zero, is not zero. Even if the same time is set for the chemical mechanical polishing apparatuses, the actual polishing time is different between the apparatuses since the time lag influences, as the instrumental errors between the apparatuses, the polishing condition such as a polishing amount.

For example, if the parameter "C" representing the instrumental errors between the apparatuses is defined as the time lag between the start of measurement and the start of polishing, an arising position of the log approximation curve "h" in FIG. 1A is not the origin 0 (zero) but a position deviated from the origin. As a result, it is anticipated that the parameter "C" can influence a value of the intercept of the straight line "i".

Therefore, for example, if the parameter "C" representing the instrumental errors between the apparatuses is given as the time lag between the start of measurement and the start of polishing, the above-described formula 5 can be expressed as follows. That is, $$\text{"polishing amount"}=A\times\text{"polishing rate"}\times\text{"polishing time"}+B+C \qquad \text{formula 6.}$$

Herein, the polishing amount is dependent on a difference between the film thickness before the chemical mechanical polishing is carried out and the target film thickness. Therefore, when the term ("film thickness before the polishing"–"target film thickness") is substituted for the term "polishing amount", the above-described formula 6 is attributed to the above-described formula 3 or 4.

As described above, the calculating formulas employed in the present invention are ones obtained by approximating, as a straight line, the position relating to the actual target polishing amount on the log approximation curve "h" representing the actual state of the chemical mechanical polishing. Therefore, by such formulas, the polishing rate and the polishing time can be calculated with high accuracy along the actual state of the chemical mechanical polishing.

Meanwhile, in a conventional method in which the parameters "A" and "B" are not considered in the chemical mechanical polishing, it has been assumed that the polishing amount represented in terms of logarithms is proportional to the polishing time. When being shown in FIG. 1A, the above-mentioned case is approximated as a straight line "g", which passes thorough the origin 0 (zero) and the point P representing the target polishing amount in the graph in which the polishing amount in terms of logarithms is represented by a vertical axis and the polishing time is represented by a horizontal axis, whereby the state of the chemical mechanical polishing has been understood. Namely, that is an idea assuming that the polishing rate is constant and the polishing amount is proportional to the time until the polishing amount reaches the point P representing the target polishing amount.

In the conventional approximation method employing the straight line "g", as is clear from FIG. 1A, it is difficult to find the portions made similar to the log approximation curve "h" representing the actual state of the chemical mechanical polishing. Meanwhile, as described above, by the calculating formula represented by formula 3, 4, or 6 proposed in the present invention, the log approximation curve "h" is sufficiently approximated in the area of the to-be-polished pattern II.

Therefore, by using the calculating formals proposed in the present invention, the optimum polishing time can be set with high accuracy. For example, it is assumed that there arises the case where: the chemical mechanical polishing is performed until the point P representing the target polishing amount; and additional polishing is further carried out to set again a point "Q" representing the final polishing amount due to any trouble in setting the target polishing amount.

In this case, it is anticipated that the point Q representing the final polishing amount is farther than the point P in the area of the to-be-polished pattern II of the log approximation curve "h". At this time, as shown in FIG. 1A, a time required for the additional polishing becomes "Δtq" that is a difference between the polishing times tp and tq.

Meanwhile, in the conventional method, the state of the chemical mechanical polishing is approximated by the straight line "g" joining the point "P" representing the target polishing amount and the origin. Therefore, the time required for the additional polishing becomes "Δtq1" that is a difference between a polishing time "tq1" at the point "Q1" representing the final polishing amount on the straight line "g" and the time "tp" at the point P. However, as shown in FIG. 1A, since "Δtq1"<<"Δtq", it is understood that a great error occurs. In contrast, since the formula in the present invention employs such a calculating formula as to able to obtain the straight line "i" sufficiently approximating the asymptotic line, the time that is close to "Δtq" with considerable accuracy and is required for the additional polishing can be calculated.

In the above description, it has been described that the formulas proposed in the present invention approximate well the actual state of the chemical mechanical polishing by exemplifying the case shown in FIG. 1A, i.e., the case where film-thickness monitoring is carried out at the convex part of the concave/convex pattern of the film surface of the product wafer that is an object to be polished. However, it is also possible to describe the same effectiveness as the above-mentioned case also from the case shown in FIG. 1B, i.e., the case where the film-thickness monitoring is carried out at the convex part. The calculating formulas proposed in the present invention are ones applicable to both of the concave and convex patterns of the film surface that is an object to be subjected to the chemical mechanical polishing.

Hereinafter, it will be described that the effectiveness of the calculating formulas proposed in the present invention can be sufficiently verified also from the case shown in FIG. 1B, i.e., the case where the film-thickness monitoring is carried out at the concave part.

In the case in which the film-thickness monitoring is carried out at the concave part illustrated by the log approximation curve "h" of FIG. 1B representing the actual state of the chemical mechanical polishing, when the chemical mechanical polishing is started, the concave part in the concave/convex pattern of the film surface that is an object to be polished is not polished at first in the to-be-polished pattern I. Therefore, although the polishing amount per unit time at the beginning is not greatly increased, the polishing amount is gradually increased as the polishing progresses. When the polishing further progresses, it is shifted from the to-be-polished pattern I to the to-be-polished pattern II. If it is assumed that its transition point is a time "t1", the polishing amount per unit time can be approximated by a straight line of which an inclination is almost constant after the time t1 elapses from the start of polishing.

Therefore, similarly to the case shown in FIG. 1A, the case shown in FIG. 1B is also understood, i.e., it is understood that the to-be-polished pattern I is a pattern in which the roughness state of the film influences exclusively the polishing conditions such as the polishing amount, the polishing speed, and the polishing time. It can be also understood that, after the polishing time t1 elapses, the factors influencing the above-described polishing conditions of the chemical mechanical polishing are mainly influenced by not the roughness state such as the concave/convex pattern of the film surface but the film property such as the film quality.

That is, similarly to the case shown in FIG. 1A, the case shown in FIG. 1B can be also understood, i.e., it can be understood that the parameter "B" influences greatly the area of the to-be-polished pattern I and the parameter "A" influences greatly the area of the to-be-polished pattern II.

Also in the case of FIG. 1B, calculation of the polishing conditions such as the polishing rate and polishing time of the chemical mechanical polishing can be conceived in the same manner as FIG. 1A, i.e., in such a manner that the entirety of the log approximation curve "h" is not required to be approximated and approximating the portions of the log approximation curve "h" within the to-be-polished pattern II suffices in order to obtain the information on the finish point of polishing relating to the final polishing amount.

Also in the case shown in FIG. 1B, as described above, the log approximation curve "h" in the area of the to-be-polished pattern II undergoes a transition along a straight line with a constant inclination, so that portions relating to such a transition can be sufficiently approximated as an asymptotic line of the log approximation curve "h". If the asymptotic line is represented as a straight line "i" (shown by a bold line in the drawing), the straight line "i" will be able to be represented by a straight-line formula with an intercept.

Also in the case shown in FIG. 1B, the straight line "i" is the same as that shown in FIG. 1A, i.e., will be able to be represented as a function, which depends on a film property such as film quality and is proportional to a polishing time, a polishing rate (a polishing amount per unit time) in the area of the to-be-polished pattern II the parameter "A" influences greatly. Therefore, the straight line "i" becomes a function of both the parameter "A" relating to the film property such as film quality and the polishing time. It can be assumed that the intercept is caused by the area of the to-be-polished pattern I showing the influences on the roughness state such as a concave/convex pattern of the film surface of the object to be polished and that the intercept becomes a function of the parameter "B" relating to the concave/convex pattern. Accordingly, as a formula indicating the straight line "i", the approximation formula represented by the above-described formula 5 is assumed.

By understanding that the parameter "C" representing the instrumental errors between the apparatuses means a parameter representing, e.g., the time lag or the like between the start of measurement and the start of polishing and that the polishing amount means the term '"pre-polishing film thickness"−"target film thickness"', the formula 5 proposed as a calculating formula well approximating the log approximation curve "h" in the to-be-polished pattern II shown in FIG. 1B can be represented as the formula 6, or further the formula 3 or 4 similarly to the case of FIG. 1A.

Accordingly, it is understood that the calculating formula employed in the present invention is one applicable regardless of the concave/convex pattern of the film surface of the object to be subjected to the chemical mechanical polishing. The calculation is not a sort that is applied to only either model of the concave and convex patterns of the film surface but a sort that can be effectively applied to the both models. Therefore, the calculating formulas have extremely high versatility. By use of such calculating formulas, the polishing rate and the polishing time can be calculated with high accuracy along the actual state of the chemical mechanical polishing.

Also in the case shown in FIG. 1B, as compared with the uses of the conventional approximation method and the calculating formulas proposed in the present invention, for example, the use of the calculating formulas relating to the present invention involves higher accuracy in the additional polishing similarly to the case shown in FIG. 1A.

Also in the case shown in FIG. 1B, as described above, approximation in the conventional approximation methods is made by the straight line "g" joining the origin and the point "P" of the target polishing amount. In this case, it is assumed that there arises the case where: the chemical mechanical polishing is performed until the point P representing the target polishing amount; and additional polishing is further carried out to set again a point "Q" representing the final polishing amount due to any trouble in setting the target polishing amount.

In this case, it is anticipated that the point Q representing the final polishing amount is farther than the point P in the area of the to-be-polished pattern II of the log approximation curve "h". At this time, as shown in FIG. 1B, a time required for the additional polishing becomes "Δtq" that is a difference between the polishing times tp and tq.

Meanwhile, in the conventional method of making approximation by the straight line "g", the time required for the additional polishing becomes "Δtq1" that is a difference between a polishing time "tq1" at the point "Q1" representing the final polishing amount on the straight line "g" and the time "tp" at the point P. However, as shown in FIG. 1B, since "Δtq1">>"Δtq", it is understood that a great error occurs.

In the case shown in FIG. 1B, when the additional polishing time is set by employing the conventional approximation method using the straight ling "g", there is a strong possibility that excessive polishing is performed and a distinctly serious fault pattern, which results in disposal of the product wafer, is formed. However, since the formulas in the present invention employs the calculating formulas indicating the straight line "i" well approximating the asymptotic line, the time that is close to "Δtq" with considerable accuracy and is required for the additional polishing can be calculated, whereby it is possible to sufficiently avoid the risk of disposing a product wafer due to the excessive polishing caused in the additional polishing.

In the chemical mechanical polishing method of the present invention, the polishing rate or polishing time which-is the polishing condition is calculated by use of the above-described calculating formula represented by the formula 3 or 4 or the like and, in accordance with the calculated value, the chemical mechanical polishing is carried out. Next, how to use the above-described calculating formulas will be described.

As described above, conventionally, when the product wafer is to be polished, a reference polishing rate has been set by use of a dummy wafer. Necessary polishing time is obtained from the reference polishing rate, preceding polishing is actually carried out by use of the product wafer, excess or deficiency of the polishing time is compensated based on the polishing result, and the chemical mechanical polishing of the predetermined number of subsequent product wafers is actually carried out.

At the time when the chemical mechanical polishing of the predetermined number of product wafers is finished, the polishing rate is reset by dividing the actual polishing amount at the time by the polishing time. The polishing time corresponding to the reset polishing rate is set again, and the chemical mechanical polishing of the predetermined number of product wafers is carried out with the reset polishing time. In the manner described above, the chemical mechanical polishing of the product wafers is carried out while the reference polishing rate is periodically reset.

The conventional reference polishing rate is used on the premise that the set reference polishing rate does not vary during the chemical mechanical polishing of the predetermined number of wafers. However, in fact, since the chemical mechanical polishing is carried out by applying a polishing pad to a surface of the object to be polished with a predetermined pressure and performing the polishing with slurry containing abrasive grains being provided therebetween, a consumable material such as the polishing pad can be consumed momentarily. However, the conventional method has been used on the premise that the consumable material such as the polishing pad is not consumed.

In FIG. 2, a transition of the actual polishing rate is schematically represented by a curve, wherein a polishing rate is represented by a vertical axis and a consumable-material used time is represented by a horizontal axis. Since the consumable material such as a polishing pad is consumed along with time, the polishing rate can be schematically illustrated by a continuously lowering curve.

However, as is shown by a stepped broken line in FIG. 2, in a conventional technique in which the reference polishing rate is revised step-by-step every time quality control (QC) is performed in a state in which the chemical mechanical polishing of the predetermined number of product wafers has been finished, deviation from the actual polishing rate is small immediately after the reference polishing rate is reset. However, at the time when the chemical mechanical polishing of the predetermined number of product wafers is performed and a need to revise the reference polishing rate occurs, there will arise the case where: the actual polishing rate is lower than the reference polishing rate which has been set at first; and the additional polishing process is required. The difference between such reference polishing rates is represented by the symbol "Δr" in the drawing.

However, since the calculating formula of the present invention is represented by the following formula 3 as described above, $$\text{"polishing rate"}=\{(\text{"pre-polishing film thickness"}-\text{"target film thickness"})-(B+C)\}/(A\times\text{"polishing time"}) \qquad \text{formula 3.}$$

In the formula 3, since the target film thickness is replaced by the post-polishing film thickness obtained through the actual polishing, the formula 3 can be modified as follows:

$$\text{"reference polishing rate"}=\{(\text{"pre-polishing film thickness"}-\text{"post-polishing film thickness"})-(B+C)\}/(A\times\textit{"polishing time"}) \qquad \text{formula 7.}$$

When values of the parameters "A", "B", and "C", the polishing time based on the past polishing record of the chemical mechanical polishing performed immediately before, and the actual polishing amount are substituted for the above-described formula 7, the latest polishing rate based on the actual state of the chemical mechanical polishing of product wafers performed immediately before can be calculated as a reference polishing rate. That is, since the polishing rate, which reflects degradation due to consumption of the consumable materials, can be always calculated in real time, it can be used as a reference polishing rate.

The calculating formula can be represented as follows. That is, $$(\text{"optimum polishing time"})_n=\{(\text{"pre-polishing film thickness"}-\text{"target film thickness"})-(B+C)\}/(A\times\text{"reference polishing rate"})_{n-1} \qquad \text{formula 8,}$$

wherein ("optimum polishing time")$_n$: an optimum polishing time of an nth product wafer, and ("reference polishing rate")$_{n-1}$: a polishing rate obtained from the past polishing record of an (n−1)th product wafer.

Thereat, the optimum polishing time of the product wafer can be set while employing, as a reference polishing rate, the latest polishing rate based on the past polishing record of the product wafer located immediately before the product wafer to be subsequently subjected to the chemical mechanical polishing. Therefore, the chemical mechanical polishing can be carried out by the optimum polishing time reflecting, for example, the continuous transition of a polishing rate such as that shown in FIG. 2.

Therefore, the additional polishing after the polishing has been completed, or the disposal due to the excessive polishing can be avoided. As a result, throughput in the chemical mechanical polishing process can be improved. As described above, since the latest polishing rate is always employed as the reference polishing rate by using the calculating formulas proposed in the present invention, the polishing time can be set with high accuracy while using, as a reference polishing rate, a value with high accuracy and based on the immediately-preceding past polishing record, without assuming that the reference polishing rate that has once been set is constant during the chemical mechanical polishing of the predetermined number of product wafers.

Since the calculating formulas are employed in the above-described manner, the actual past polishing record of the chemical mechanical polishing can be always reflected to the polishing rate. Furthermore, based on the actual past polishing record of the chemical mechanical polishing, the values of the parameters "A" and "B" can also be corrected so that the calculating formulas correspond to the actual polishing state.

As described above, even when fixed values are employed for the parameters "A", "B", and "C" from the beginning, the polishing rate or polishing time can be calculated with higher accuracy than the case where the parameters "A", "B", and "C" are not employed. However, as a means for further enhancing the accuracy, self-correction of the parameters "A" and "B" may be carried out.

The self-correction of the parameters "A" and "B" is carried out in the following manner. That is, when the polishing of each product wafer is finished about the currently performed chemical mechanical polishing, the past polishing records are recognized as points on two axes representing the polishing time and the polishing amount, respectively. For example, the past polishing records are dotted as shown in FIG. 3. The dots of the past polishing records increase in accordance with the number of product wafers to which the chemical mechanical polishing is performed. Therefore, when a certain amount of dots are reserved, the appropriate straight-line formula of which correlation coefficients corresponding to the plurality of dots become high can be set by use of, for example, a least squares method. The values of the parameters "A" and "B" can be corrected by varying the parameters "A" and "B" in the calculating formulas so as to overlap with the straight-line formula. In practice, this operation can be easily carried out by using a calculation function of a computer.

In FIG. 3, such a state is illustrated. More specifically, with respect to the target polishing amount represented by the horizontal broken line, the plurality of dots representing the past polishing records are shown in the drawing. Since the polishing is actually carried out under the polishing condition calculated from the calculating formulas represented by use of the parameters "A", "B", and "C" which have been set from design data etc., each of the above-mentioned dots indicates the record obtained per polishing.

FIG. 3 shows that as the number of dots representing the past polishing records is increased, a correlation is lowered between the dots and a straight line "j" representing the calculating formula employing the parameters "A", "B", and "C" having been set from initial design data etc. and thereby a straight line "k" becomes one having high correlation coefficients with respect to the dots of the past polishing records. In this case, if it is assumed that the terms corresponding to the parameters "A" and "B" of the formula representing the straight line "k" indicate values of $\alpha$ and $\beta$, the above-mentioned calculating formula can be changed into a calculating formula better matching the actual polishing records by self-correct the initially set parameters "A" and "B" to the values of $\alpha$ and $\beta$. That is, $$\text{"polishing amount"} = \alpha \times \text{"polishing rate"} \times \text{"polishing time"} + \beta + C \qquad \text{formula 6.}$$

Since the above-described parameters "A" and "B" are appropriately corrected, the calculating formula matching the state of the chemical mechanical polishing that is now performed can be always formed. In the case of using a method in which the parameters "A", "B", and "C" are fixed, it is premised that the actual state of the chemical mechanical polishing is fixed to a model of chemical mechanical polishing represented by the initial calculating formulas. However, the method in which the parameters "A" and "B" are self-corrected corresponds to a slightly change in the model of chemical mechanical polishing representing the actual state of the chemical mechanical polishing.

Next, treatments of the parameters "A", "B", and "C" in the calculating formulas will be described. The parameter "A" relates to a film property such as film quality of an object to be subjected to the chemical mechanical polishing. In the case where the past chemical mechanical polishing records employing the above-mentioned calculating formulas have already been about the product wafers of the same type in performing the chemical mechanical polishing to the product wafers, the chemical mechanical polishing is started in accordance with the value of the parameter "A" employed above. After the chemical mechanical polishing is started, as described above, since the parameters are self-corrected based on the actual polishing state, the parameter "A" better reflecting the state of the actually performed chemical mechanical polishing can be set.

As described above, the parameter "B" relates to a roughness state such as a concave/convex pattern of the film that is an object to be subjected to the chemical mechanical polishing. Similarly to the parameter "A" about the parameter "B", if the past chemical mechanical polishing records employing the calculating formulas have already been, the values then employed may be used at first. Thereafter, by correcting the parameter "B" in accordance with the actual state of the chemical mechanical polishing, the parameter "B" may be matched better with the actual state of the chemical mechanical polishing.

As described above, the parameter "C" represents an instrumental error between apparatuses in a polishing condition such as a polishing amount in the case of using a plurality of chemical mechanical polishing apparatuses, or an instrumental error between heads in the case of employing a plurality of polishing heads in the same chemical mechanical polishing apparatus. If it is assumed that conditions on the product wafer side, except for members relating to the chemical mechanical polishing apparatuses and the polishing heads, are the same, the parameter "C" may be defined as one representing an instrumental error in the polishing condition between the apparatuses at a time of performing the chemical mechanical polishing.

The parameter "C" is set in advance for each apparatus or each head, and may be selected and used for each apparatus or head to be actually used for the chemical mechanical polishing. The parameter "C" is set as an inherent value for the apparatus or head, and does not vary in accordance with the past polishing records of the product wafers. As described above, such a parameter "C" can be defined as, for example, a time lag between a start of measurement of the polishing time and an actual start of performing the polishing.

If the parameter "C" is defined as the above-described time lag, as shown in formula 3 etc., the parameter "C" may be included in the calculating formulas by use of the operator of addition (+). According to how the parameter "C" is defined, the parameter may be included in the calculating formulas by appropriately employing the operator of multiplication (×) or division (÷).

Also, in calculating the above-described parameters "A", "B", and "C", when no past polishing record is provided due to, e.g., a new type of product wafer or implementation of a new process, the design data of the product wafers may be used. Alternatively, past data records of product wafers similar to the product wafers may be used.

As described above, new parameters must be set in the case of using the new type or new process. However, the parameter "A" of the calculating formulas depends on the film property such as the film quality of the film that is an object to be polished, and the parameter "B" depends on the roughness state of the film surface of the film that is an object to be polished. Therefore, the parameters are parameters of the kind that can be determined from the design data of semiconductor devices such as data of a pattern occupying ratio, a pattern density, and a pattern height.

Thus, since the parameters can be determined in advance, for example, from the design data, there is no need to obtain conditions for determining the parameters. Therefore, using a dummy wafer, performing preceding polishing, and the like are not required, whereby it is possible to cut out labor of a cumbersome condition-obtaining process that requires manpower, and make cutbacks in personnel, and reduce the number of steps.

Furthermore, since the chemical mechanical polishing apparatuses to be actually used are employed for obtaining the conditions, the actual chemical mechanical polishing of the product wafers has not been performed thus far during the condition-obtaining process. However, since the condition-obtaining process can be made unnecessary, production capacity of the chemical mechanical polishing apparatus does not deteriorate.

In the foregoing description, there has been described the case where, unlike the conventional methods by using the above-described calculating formulas, the highly accurate reference polishing rate well matching the actually applied state of the chemical mechanical polishing or the optimum polishing time can be set for carrying out the chemical mechanical polishing. However, a chemical mechanical polishing system, in which the chemical mechanical polishing method can be effectively used at a time of manufacturing the semiconductor devices, will be described hereinafter.

FIG. 4 is a view schematically showing a configuration of a chemical mechanical polishing system for carrying out a chemical mechanical polishing method at a time of manufacturing the semiconductor devices according to the present invention.

The configuration of the chemical mechanical polishing system shown in FIG. 4 includes: a measurement means 10 for measuring the film thickness of a product wafer having a film formed in a process prior to a chemical mechanical polishing process; a chemical mechanical polishing means 20 for carrying out the chemical mechanical polishing; and a measurement means 30 for measuring the film thickness of the product wafer after the chemical mechanical polishing. The measurement means 10 and 30 and the chemical mechanical polishing means 20 are connected to a host computer 40*a* serving as a control means 40 of the chemical mechanical polishing processes so that data can be transmitted therebetween.

The host computer 40*a* is connected to a calculating computer 50*a* serving as a calculating means 50 for calculating a polishing condition such as a polishing rate or polishing time of the product wafer in the chemical mechanical polishing means 20 so that data can be transmitted therebetween. The calculating computer 50*a* is connected to a data storage means 60 including design data such as a deposition pattern of a product wafer and/or a target film thickness of the semiconductor device so that data can be transmitted therebetween.

In addition, in order to change and compile the parameters in the calculation formula to be used as occasion demands at a time of performing treatments by the calculating computer 50*a* and in order to carry out data update of the parameters from outside of a clean room if necessary, the calculating computer 50*a* is connected to a computer 70*a* serving as a data updating means 70 so that data update is possible therebetween.

When the chemical mechanical polishing of the product wafer is to be carried out by use of the chemical mechanical polishing system shown in FIG. 4, at the host computer 40*a* serving as the control means 40 of the chemical mechanical polishing process in accordance with a recipe there are at first determined settings such as types of product wafers used in the chemical mechanical polishing to be subsequently performed, which step in the manufacturing process of semiconductor devices the above-mentioned chemical mechanical polishing process corresponds to, and/or which chemical mechanical polishing apparatus is to be employed.

According to a command from the host computer 40*a*, the calculating computer 50*a* calculates the polishing conditions for carrying out the chemical mechanical polishing of the product wafers on the basis of the calculating formulas represented by the above-described formula 4. The data required for the calculation is selected from parameter tables 51 that are retained in the calculating computer 50*a* in advance.

As shown in FIG. 4, numerical data of the parameters "A", "B", and "C" included in the calculating formulas is stored in the parameter tables 51 on the basis of, for example, the past polishing records. The parameters "A" and "B" are individually retained as numerical data for each type of product wafers per process. The parameter "C" is retained as numerical data that is set per chemical mechanical polishing apparatus, or set per head if a plurality of polishing heads are provided in one apparatus.

As described above, for example, when the product wafer to be used is a new type or when chemical mechanical polishing is to be carried out in a new process, the numerical data based on the past polishing records is not present. Therefore, the calculating computer 50*a* accesses the data storage means 60 and selects the numerical data to be used as the parameters "A" and "B" from the design data of each product wafer retained in the storage means 60.

Also, the values of the target film thickness required in the calculating formulas can be obtained from the recipes of the chemical mechanical polishing retained in the host computer 40*a*. Needless to say, the values may be obtained by referring to the design data provided in the storage means 60.

In addition, the film thickness of the product wafers that are objects to be subjected to the chemical mechanical polishing are measured per product wafer by use of a non-contact type film-thickness measurement apparatus 10*a* constituting the measurement means 10 etc., and the calculating computer 50*a* obtains film-thickness measurement data via the host computer 40*a*. Although accuracy is inferior according to circumstances, target film-thickness data at a time of forming a film that is an object to be subjected to the chemical mechanical polishing may be used from the design data by accessing the storage means 60.

If the past polishing records are provided, the numerical data thereof can be employed as the polishing rate. However, if no past polishing records are provided or if a change in the polishing rate is expected due to any man-caused factor, quality control (QC) may be performed for setting the rate only at first.

When the pre-polishing film thickness, the target film thickness, the parameters "A", "B", and "C", and the polishing rate are set as described above, the calculating computer 50*a* calculates the polishing time of the first product wafer by use of, for example, the following formula 4 as the calculating formula:

$$\text{"polishing time"}=\{(\text{"pre-polishing film thickness"}-\text{"target film thickness"})-(B+C)\}/(A\times\text{"polishing rate"}) \quad \text{formula 4.}$$

The host computer 40*a* obtains the calculated polishing time and, in accordance with the recipe of the chemical mechanical polishing, carries out the chemical mechanical polishing at the specified chemical mechanical polishing apparatus 20*a* of the chemical mechanical polishing means 20 during the polishing time.

After the chemical mechanical polishing is finished, the film thickness of the product wafer after the polishing is measured by the non-contact type film-thickness measurement apparatus 30*a* etc. constituting the measurement means 30, and the measured value is sent to the host computer 40*a*. In accordance with the progress of the chemical mechanical polishing of a first product wafer, the pre-polishing film thickness of a second product wafer is also measured by the measurement means 10, and sent to the host computer 40*a* in the above-described manner.

The polishing time of the second product wafer is calculated by the calculating computer 50*a*, i.e., is obtained from the formula 8 by using: the reference polishing rate calculated by the formula 7 and the film-thickness data of the first product wafer after the polishing; the parameters "A", "B", and "C" used for calculating the polishing time of the first product wafer; and the actual measurement data of the film thickness of the second product wafer before the polishing.

The chemical mechanical polishing is actually carried out by use of the calculated polishing time of the second product wafer. In this manner, the chemical mechanical polishing of a subsequent product wafer is carried out based on the polishing rate calculated from the past polishing record of the immediately-preceding product wafer.

Note that, in the above description as an example of the reference polishing rate, the case where the polishing rate calculated from the past polishing record of the immediately-preceding product wafer serves as a reference has been described. However, for example, when the product wafer is a new type or when polishing is to be carried out in a new process, there is a strong possibility that the chemical mechanical polishing of the product wafer will not be made stable. Therefore, until the chemical mechanical polishing can be considered to be stable, the chemical mechanical polishing may be carried out by using the initially set polishing rate as a reference. Thereafter, at the stage where the chemical mechanical polishing is considered to be stable, the past polishing record of an immediately-preceding product wafer may be used for calculating the polishing time of the subsequent product wafer.

Furthermore, in the case where only the past polishing record of the immediately-preceding product wafer is employed as a reference polishing rate, if the polishing of the immediately-preceding product wafer is abnormal, the possibility to employ the abnormal value as a reference is strong. Therefore, certainly, there may be adopted a method in which, based on the past polishing records of the plurality of product wafers up to the immediately-preceding product wafer, the reference polishing rate is calculated, for example, by employing an average polishing rate.

Thus, by using the chemical mechanical polishing system with the above-described configuration, the chemical mechanical polishing process in the semiconductor device manufacture is different from the conventional ones. Therefore, since the dummy wafer used prior to the chemical mechanical polishing of the product wafers or the condition-obtaining process for performing the preceding polishing or the like can be omitted, manufacturing costs of the semiconductor devices can be reduced.

Moreover, by using the chemical mechanical polishing system having the above-described configuration, the initially set parameters "A" and "B" in the calculating formulas used for carrying out calculation in the calculating computer 50*a* can be appropriately corrected to the proper values in accordance with the past polishing records. For example, the chemical mechanical polishing of the product wafers is carried out by use of the parameters "A", "B", and "C" that have been initially set in the above described manner, the past polishing records are dotted in a quadrant defined by two axes of the polishing amount and the polishing time as described above, and the initial parameters of the calculating formulas are changed so that the correlation coefficients with the dots become high.

The change in the above-described calculating formulas can be made while inputting various values to the parameters "A" and "B" by use of the calculating means 50 such as the calculating computer 50*a*. Thus, the calculating formulas are progressively self-corrected by replacing, with the values of the initially set parameters "A" and "B", the values of the parameters "A" and "B" changed so that the correlation coefficients with the dots representing the past polishing records become high. Therefore, the chemical mechanical polishing better matching the actual state of the chemical mechanical polishing can be performed.

Note that, also regarding the self-correction of the parameters "A" and "B", when the number of past polishing records is small, there is a possibility that abnormal values will be corrected to original ones. Therefore, setting and cancel of the correction functions of the parameters may be configured to be freely performed so that such self-correction of the parameters is not made until the past polishing records are accumulated to some degrees.

Regarding the calculating formulas used for calculating the polishing condition such as a polishing time and/or a polishing rate in the calculating computer 50*a*, it is also conceived sufficiently that there is the case where the parameter compiling is required, i.e., changing definition of the parameters, changing the values of the parameters to completely different values in accordance with a state of the chemical mechanical polishing on a different line, adding any other parameters, deleting any existing parameters, or the like is required.

In such a case, in the chemical mechanical polishing system shown in FIG. 4, update can be carried out by appropriately compiling the parameters included in the calculating formulas in the calculating computer 50*a* from the computer 70*a* etc. serving as a data updating means 70. The above computer 70*a* may be configured so that an update process such as compiling of the parameters can be performed from the outside of the clean room in which the chemical mechanical polishing apparatus is placed, for example, by connecting the computer to a network to which the relevant chemical mechanical polishing apparatus for carrying out the chemical mechanical polishing of the product wafers is connected or to a backbone network to which the network is connected.

Since such a system configuration is established, the state of the currently-progressing chemical mechanical polishing can be checked from the outside of the clean room and there is no need to go into the clean room every time for checking the state of the chemical mechanical polishing or for carrying out the parameter updating process from the host computer 40*a*. Therefore, labor in indirect operations can be saved, whereby efficiency thereof can be promoted.

Hereinabove, the invention made by the present inventors has been specifically described based on the embodiment. However, needless to say, the present invention is not limited to the above-described embodiment and can be variously modified and altered without departing from the gist thereof.

In the above description, the case of defining the film quality as the parameter relating to the film property has been given as one example. However, parameters representing a film property other than film quality may be employed.

The case of defining the time lag between the start of measurement and the start of polishing as the parameter representing the instrumental errors between the apparatuses has been given as one example. However, a parameter representing an instrumental error between the apparatuses other than the above-mentioned case may be employed.

In the above-described configuration of the chemical mechanical polishing system, the measurement means and the chemical mechanical polishing means are independently shown in the drawing and described. However, the chemical mechanical polishing apparatus constituting the chemical mechanical polishing means may have a structure for sharing the measurement means.

Furthermore, although each of the host computer, the calculating means, and the storage means is independently illustrated and described, it goes without saying that a device serving as each means may include another means. Data transmission between the means may be carried out via a cable or by radio. Certainly, if necessary, a data storing means such as a portable CD, DVD, or FD may be employed.

Second Embodiment

In a chemical mechanical polishing method for a multi-layer structure comprising a plurality of stacked films, which is the present invention, when a polishing rate of a certain stacked film among the plurality of stacked films that are objects to be subjected to the chemical mechanical polishing is converted is converted into that of another stacked film and when each polishing time of the chemical mechanical polishing of the plurality of stacked films that are objects to be polished is to be set, this embodiment employs a novel conversion table by which the conversion results can be distinctly easily determined.

In the chemical mechanical polishing of the multi-layer structure, the above-described novel calculating formulas found out by the present inventors can be employed, and a polishing condition such as a polishing rate or polishing time is calculated, thereby allowing the chemical mechanical polishing to be performed with higher accuracy.

In the present embodiment, the case where the chemical mechanical polishing of the plurality of stacked films according to the present invention is carried out by use of the calculating formulas described in the above-described first embodiment will be described. In the chemical mechanical polishing method according to the present invention, a polishing rate of a certain stacked film among the plurality of stacked films that are objects to be subjected to the chemical mechanical polishing is converted into that of another stacked film and each polishing time of the chemical mechanical polishing of the plurality of stacked films that are objects to be polished is set. Particularly, this embodiment newly proposes employing a conversion table by which the conversion results can be distinctly easily understood and determined in converting the polishing rates.

In the above-described first embodiment, the case where the object to be subjected to the chemical mechanical polishing is a single-layer film with concave/convex roughness has been described as one example. More specifically, there has been described, as one example, the case where the log approximation curve "h" representing the actual polishing state can be schematically divided into the to-be-polished pattern I greatly influenced by the roughness state such as a concave/convex pattern on the film surface exerts great effects and the to-be-polished pattern II greatly influenced by the film property such as the film.

However, in some cases, the object to be polished in the chemical mechanical polishing may be not only such a single-layer film but also the stacked films in which the plurality of films are stacked. By using the calculating formulas described in the first embodiment and proposed by the present inventors, the chemical mechanical polishing can be also performed with higher accuracy to the multi-layer structure comprising the plurality of stacked films.

In applying the above-described calculating formulas to the multi-layer structure comprising the plurality of stacked films that are the objects to be polished, the present inventors have conceived that, in order to efficiently carry out the actual chemical mechanical polishing, a plurality of stacked films comprising different types of films are converted into a particular film type and can be polished uniformly by using a polishing time required for performing the chemical mechanical polishing at the polishing rate of the particular film type.

Thus far, since the polishing conditions are generally different per film type in the chemical mechanical polishing of the multi-layer structure comprising the plurality of stacked films of different types, the chemical mechanical polishing apparatus is allotted to each of the film types, whereby the polishing is carried out by a plurality of chemical mechanical polishing apparatuses. Alternatively, there has been taken measures in which polishing stages are changed for each of the different film types in the chemical mechanical polishing apparatus employing a multi-head.

However, the present inventors have conceived that, if the chemical mechanical polishing can be carried out without using the plurality of different chemical mechanical polishing apparatuses or polishing heads even in the case where the object to be polished is a multi-layer structure comprising stacked films of different types, it is preferable also in regard to an apparatus configuration, availability efficiency of the apparatus, and further working efficiency of the chemical mechanical polishing.

For example, in the case where the object to be subjected to the chemical mechanical polishing is shown in FIG. 5A, a multi-layer structure S is such that when a stacked film 200, whose film type is a metal film 200*a* used in a wiring or the like, is provided on a layer 100 formed on a semiconductor wafer and a stacked film 300, whose film type is an insulating film 300*a* made of, for example, trimethyl phosphate, is formed thereon, a convex part 310 is formed on the surface of the stacked film 300 due to the stacked film 200.

It is assumed that the chemical mechanical polishing is carried out up to the broken line shown by an arrowhead with respect to the multi-layer structure S, i.e., is carried out from the stacked film 300 serving as a first layer (uppermost layer) up to a broken line L into which the stacked film 200 serving as a second layer below the first layer is ground. In this case, as shown in FIG. 5B, the log approximation curve "h" representing the actual state of the polishing will firstly indicate: a to-be-polished pattern I relating to the convex part 310 of the stacked film 300 of the first layer; a to-be-polished pattern II corresponding to grinding of the stacked film 300 of the first layer ground into the convex part 310 and planarized; and a to-be-polished pattern III corresponding to being ground into the stacked film 200 of the second layer after the polishing of the stacked film 300.

In the above configuration, in order to correspond to the case described in the first embodiment, as shown in FIG. 5B, it is preferable that the polishing time can be calculated by using the asymptotic line of the log approximation curve "h" shown in the area of the to-be-polished pattern II and that the polishing time corresponding to a portion of the stacked film 200 belonging to the to-be-polished pattern III can be calculated by converting the polishing rate of the stacked film 200 to that of the stacked film 300. In converting such a polishing rate, the present inventors have made this embodiment so that the conversion is easily carried out by using a conversion table.

The conversion table may be configured so that polishing rates, each of which determined by a combination of the film types constituting the stacked film and the polishing conditions, are shown in a matrix format. FIG. 6, shows one example of the conversion table.

The conversion table shown in FIG. 6 indicates the film types constituting the stacked film in a vertical direction and the polishing conditions of the chemical mechanical polishing in a horizontal direction, and is configured so that a polishing rate can be determined at a position where the film type and the polishing condition cross. Particularly, in order to facilitate the conversion of the polishing rates, if it is assumed that the polishing conditions of the chemical mechanical polishing are set as α, β, γ, . . . , etc, the case shown in FIG. 6 is illustrated as a ratio (selection ratio) of the polishing rate to film types "A", "B", "C", . . . , etc. the polishing rate being determined by the film type "A" set as a reference and a polishing condition α set as a reference.

More specifically, when the polishing rate determined by the film type "A" and the polishing condition α is 1.0, the polishing rates determined by other film types and polishing conditions can be easily judged how much ratio they exist at.

Note that although having been described also in the first embodiment, the polishing conditions are determined by a combination of parameters at a time of being employed in the present embodiment, the above parameters being influenced by the polishing rates that are based on, for example, a polishing pressure, a rotation speed, an abrasive material, a flow rate of polishing material, a mixing ratio of two or more liquids to be used as an abrasive, and the like.

As shown in FIG. 6, in creating the conversion table showing information relating to the selection ratio set in advance, the polishing rates based on the actual film types and polishing conditions of the predetermined multi-layer structure may be presented. Alternatively, experiments may be carried out for obtaining various polishing conditions.

As described in the first embodiment, the polishing rates shown in the conversion table are set so that the parameters appropriately used in the calculating formulas can be changed for setting the proper polishing rates based on the past polishing records. Such a process can be easily carried out by employing the configuration of the chemical mechanical polishing system described in the first embodiment and shown in FIG. 4.

For example, in the case where the chemical mechanical polishing of the multi-layer structure "S" shown in FIG. 5A is to be carried out, it is assumed that the first-layer stacked film 300 is composed of the film type "A" and the second-layer stacked film 200 is composed of the film type "B". Within the range of the log approximation curve "h" representing the actual state of chemical mechanical polishing of the multi-layer structure "S" with the above-described configuration, the chemical mechanical polishing of the stacked film 300 of the film type "A" is carried out under the polishing condition α, and the chemical mechanical polishing of the stacked film 200 of the film type "B" is carried out under the polishing condition γ.

In this case, the polishing time of the stacked film 200 is calculated by carrying out such conversion that if it is assumed that the stacked film 200 composed of the film type "B" is used as the stacked film 300 of the film type "A", the chemical mechanical polishing is performed under the polishing condition α. At this time, according to the conversion table shown in FIG. 6, the selection ratio of the polishing rate at the position where the film type "B" and the polishing condition α intersect is 0.5. Therefore, it is obvious at a glance that the polishing time of the stacked film 200 is set to 1/0.5, i.e., twice the polishing time of the stacked film 300.

Meanwhile, each of the target polishing amounts of the stacked films 300 and 200 can be determined from the actual film thickness before the chemical mechanical polishing, and the target film thickness. The actual film thickness can be obtained through the film-thickness measurement. The target film thickness can be checked from the design values.

Thus, the respective polishing times of the stacked films 300 and 200 can be calculated from both of the selection ratio of the polishing rates of the stacked films 300 and 200 and the target polishing amount.

In the above-description, the cases where a trimethyl phosphite (TMP) film is applied as a specific example of the stacked film 300 and where a metal film is applied as the stacked film 200 have been described. However, needless to say, the film types of the stacked films 300 and 200 are not limited to the above-described cases.

In addition, the case where the calculating formulas of the chemical mechanical polishing approximated by the asymptotic line "i" relating to the to-be-polished patterns I and II of FIG. 1A described in the first embodiment are applied means, for example, the case where the chemical mechanical polishing is finished within the single layer of the stacked film 300 shown by the broken line L1 in FIG. 5A.

Third Embodiment

In the above second embodiment, there has been described the case where the multi-layer structure "S" shown in FIG. 5A comprises the first-layer (uppermost-layer) stacked film 300 and the second-layer stacked film 200 corresponding to a non-uppermost layer and the polishing times are calculated by converting the polishing rate of the second-layer stacked film 200 to that of the stacked film 300. However, it has newly become clear that use of the conversion table shown in FIG. 6 can be applied to a chemical mechanical polishing method other than the above-described chemical mechanical polishing method.

That is, the description of the second embodiment is about the case where one of the stacked films of different types is converted to the other to carry out the chemical mechanical polishing under the same polishing condition. However, it can be seen in the conversion table that the selection ratio of a combination of the film type "A" and the polishing condition α is the same as that of a combination of the film type "B" and the polishing condition γ.

Therefore, unlike the above second embodiment, the chemical mechanical polishing of the stacked film 300 composed of the film type "A" may be carried out under the polishing condition α, and the chemical mechanical polishing of the stacked film 200 composed of the film type "B" may be carried out under the polishing condition γ. That is, by intentionally employing the different polishing conditions, the plurality of different types of stacked films are subjected to the polishing at the same polishing rate. Since the same polishing rate is set for the stacked films 300 and 200, the polishing time becomes dependent only on the target polishing amount, whereby the polishing time can be distinctly easily controlled.

Fourth Embodiment

In the above second embodiment, there has been described the case of converting the stacked film 200 to the stacked film 300 and continuously performing the polishing at the same polishing condition α. However, in order to improve efficiency of the polishing, the chemical mechanical polishing of the stacked film 300 having a polishing amount greater than that of the stacked film 200 may be carried out: at first, under the condition that the polishing speed is fast but the polishing accuracy is poor; and thereafter at a time of approaching the stacked film 200, under the condition that the polishing speed is slowed down so as to maintain the above-mentioned polishing accuracy.

For example, the polishing of the stacked film 300 composed of the film type "A" may be carried out: initially under the polishing condition γ; and thereafter at a time of approaching the stacked film 200 composed of the film type "C", under the polishing condition α. More specifically, the above chemical mechanical polishing method is a method for improving the polishing efficiency by changing the polishing conditions of the same layer with the conversion table and changing the polishing speed from fast to slow.

The same material layer that is an object to be subjected to the chemical mechanical polishing can be applied to the case of, for example, being polished subsequently by initially a first polishing rate and then a second polishing rate. In this case, the first and second polishing rates may be selected from the conversion table in which the respective polishing rates determined by the combination of the layer-formation materials and polishing conditions are read, whereby the polishing time of the same material layer can be determined from a total of the polishing times calculated by the first and second polishing rates.

The above-method method is different from the conventional method in which the polishing of the same layer has been carried out at the same polishing rate until now, and is the novel chemical mechanical polishing method proposed by the present inventor, i.e., obtained by combining the cases where the polishing is carried out by considering preferentially the polishing speed and where the polishing is performed by considering the polishing accuracy.

Note that, needless to say, the above-described polishing method can be applied not only to the case of forming the multi-layer structure but also the case of performing the chemical mechanical polishing to a single-layer of a single-layer structure.

Fifth Embodiment

In the present embodiment, the following case will be described: when the chemical mechanical polishing of the multi-layer structure "S" is carried out in accordance with the polishing time calculated by the formulas of the asymptotic line "i" of the log approximation curve "h" representing the actual polishing state shown in FIG. 5B, the polishing condition is appropriately selected so as to control the finish time of the chemical mechanical polishing. For example, when a processing time of the chemical mechanical polishing process is excessively fast or slow in comparison with those of processes before and after the chemical mechanical polishing process, a wait time is generated between the processes. If the wait time between the processes is generated, equipment such as stockers for temporarily keeping process wafers etc. is required. Preferably, flow between the processes is smoothly adjusted without employing such stockers etc. The tendency is particularly high in a single wafer processing.

In such a case, the chemical mechanical polishing is not performed as described in the second embodiment, i.e., the chemical mechanical polishing is not performed to the stacked films 300 and 200 relating to the film types "A" and "B", which are unified by the polishing condition α, but, for example, unification by the polishing condition γ may be employed so that the entire processing time of the chemical mechanical polishing can be adjusted to be short.

Alternatively, the polishing condition β may be set so that no wait time is generated before and after the chemical mechanical polishing process by intentionally elongating the entire processing time. Alternatively, without unifying the polishing conditions of the stacked films 300 and 200, the entire processing time of the chemical mechanical polishing process may be adjusted at will, for example, by carrying out the polishing of the stacked film 300 of the film type "A" under the polishing condition β and carrying out the polishing of the stacked film 200 of the film type "B" under the polishing condition γ.

Hereinabove, the invention made by the present inventors has been described in detail based on the embodiments. However, needless to say, the present invention is not limited to the above-described embodiments, and can be variously modified and altered without departing from the gist thereof.

In the above-described second to fifth embodiments, as shown in FIG. 5A, the case where the object to be subjected to the chemical mechanical polishing is the two-layer stacked film comprising the stacked films 300 and 200 has been described. However, needless to say, the above-mentioned multi-layer structure is not limited to a two-layer structure, and may be applied to a three-or-more-layer structure.

In the above-described second embodiment, the case where the stacked film 200 which is not the uppermost layer is converted to the uppermost-layer stacked film 300 has been exemplified. However, for example, it may be converted to the stacked film 200 or an intermediate layer in a multi-layer structure including three or more layers. The stacked layer serving as a reference of conversion may be arbitrary set to be, for example, an uppermost layer, intermediate layer, or undermost layer.

The present invention can be utilized in a field of the semiconductor device manufacturing in which the chemical mechanical polishing is carried out.

What is claimed is:

1. A chemical mechanical polishing method comprising the step of performing chemical mechanical polishing in accordance with a value obtained by a calculating formula including:

(a) a parameter representing an influence of a film property of a film to be polished on said chemical mechanical polishing;

(b) a parameter representing an influence of a roughness state of the film to be polished on said chemical mechanical polishing; and (c) a parameter representing an influence of an instrumental error between apparatuses in a chemical mechanical polishing apparatus on said chemical mechanical polishing.

2. The chemical mechanical polishing method according to claim 1, wherein at least one of said parameters included in said calculating formula is corrected in accordance with a polishing state of the product wafer.

3. A chemical mechanical polishing method comprising the steps of:

calculating a value from a calculating formula including a parameter representing an influence of a film property of a film to be polished on chemical mechanical polishing and a parameter representing an influence of a roughness state of the film to be polished on the chemical mechanical polishing;

performing the chemical mechanical polishing to a multi-layer structure, in which a plurality of different layers are stacked on a semiconductor wafer, in accordance with the value; and determining a polishing time of each of layers, which are objects to be polished of the chemical mechanical polishing in said multi-layer structure, in accordance with a polishing rate of each of layers selected from a conversion table, which is read from the polishing rate determined by a combination of a layer-forming material and a polishing condition.

4. The chemical mechanical polishing method according to claim 3, wherein a polishing time of a layer formed of a different layer-forming material among layers that are said objects to be polished is determined by calculating a polishing rate, which is based on a polishing condition selected from said conversion table, so that a polishing finish time of said multi-layer structure becomes a predetermined time.

5. A chemical mechanical polishing method comprising the steps of:

calculating a value from a calculating formula including a parameter representing an influence of a film property of a film to be polished on chemical mechanical polishing and a parameter representing an influence of a roughness state of the film to be polished on the chemical mechanical polishing;

performing the chemical mechanical polishing to a single-layer structure, in which a single layer is formed on a semiconductor wafer, in accordance with the value; and determining a polishing time of said single layer by calculating a polishing rate, which is based on a polishing condition selected from a conversion table from which a polishing rate determined by a combination of a layer-forming material and a polishing condition is read, so that a polishing finish time of said single-layer becomes a predetermined time.

* * * * *